United States Patent [19]

Bishop et al.

[11] Patent Number: 4,706,745

[45] Date of Patent: Nov. 17, 1987

[54] LOCK-DOWN RELEASING SPEAR ASSEMBLY

[75] Inventors: Thomas R. Bishop; Wayne A. Kovar; Clyde D. Roque, all of Houston, Tex.

[73] Assignee: Bowen Tools, Inc., Houston, Tex.

[21] Appl. No.: 941,617

[22] Filed: Dec. 15, 1986

Related U.S. Application Data

[63] Continuation of Ser. No. 784,596, Oct. 4, 1985, abandoned.

[51] Int. Cl.[4] ..... E21B 31/20

[52] U.S. Cl. ..... 166/98; 166/301; 294/86.17; 294/86.22

[58] Field of Search ..... 166/98, 301; 294/86.17, 294/86.18, 86.19, 86.22, 86.24, 86.25

[56] References Cited

U.S. PATENT DOCUMENTS

| | | | |
|---|---|---|---|
| 1,414,511 | 5/1922 | Gray | 294/86.22 |
| 1,653,547 | 12/1927 | Cameron | 294/86.22 |
| 2,487,456 | 11/1949 | Lowrey | 294/86.22 |
| 2,595,014 | 4/1952 | Smith et al. | 166/98 |
| 3,343,606 | 9/1967 | Dollison | 166/98 |

*Primary Examiner*—Stephen J. Novosad
*Assistant Examiner*—Terry Lee Melius
*Attorney, Agent, or Firm*—B. R. Pravel

[57] ABSTRACT

An apparatus for engaging a tubular member with a tension type spear in which the spear is locked to the tubular member so that it is not released when compressive or other non-tension loads are applied to it. The present invention locks the spear to the tubular member through abutment of a transfer assembly connected to the spear supporting mandrel after the spear has been set within the tubular member. The abutment of the transfer assembly and the tubular member lock the spear within the tubular member under tension so that compressive or other non-tension loads on the supporting pipe string will not affect the grip of the spear.

8 Claims, 10 Drawing Figures

LOCK-DOWN RELEASING SPEAR ASSEMBLY

This is a continuation of application Ser. No. 784,596 filed Oct. 4, 1985, now abandoned.

FIELD OF THE INVENTION

The present invention relates to a method of engaging a pipe with a tension type spear wherein the spear is locked to the pipe so that it is not released when compressive or other non-tension loads are applied to it. More particularly, the present invention relates to a releasing spear assembly which may be locked to a tubular member so as to avoid release of the tubular member when a tension, neutral, or compressive force is applied to the releasable spear.

BACKGROUND OF THE INVENTION

In the drilling of oil, gas, or other types of wells, tubular members such as drill pipe or production tubing are employed and typically the borehole is lined with tubular members such as casings. The casing prevents collapse of the borehole, avoids contamination of the producing strata and avoids contamination or leak off of the produced fluid or gas. Tubing or drill pipe comprising threadedly interconnected segments of pipe is employed to raise and lower or run tools within the casing and in the drilling of the borehole prior to the location of the casing within the borehole. The removal of such tubing or drill pipe when stuck or inadvertently released in the borehole is typically accomplished with a releasing spear which engages the internal diameter of the tubing member. The removal of casing or other tubular members from the borehole when required is a difficult and time consuming operation. Typically a releasing spear which includes an expandable grapple oriented on a mandrel is employed. The grapple fits closely within the tubular member to be removed and is set by releasing of the grapple from a support so that pulling upwardly on the mandrel forces the expandable grapple into contact with the interior diameter of the tubular member.

The connection between the grapple and mandrel is such that tension on the mandrel forces the grapple to expand into engagement with the tubular member. Since such releasable spears rely upon tension on the mandrel to maintain the engagement between the expandable grapple and the tubular member, if tension on the pipe string supporting the mandrel is not maintained or compressive forces are applied, engagement of the tubular member by the grapple can be lost.

The lock-down releasable spear assembly and method of the present invention provides for locking of a grapple within a section of a tubular member such that the engagement of the grapple with the interior diameter of the tubular member is not released by neutral or even compressive loads upon the supporting pipe string. Thus, the lock-down releasing spear assembly of the present invention prevents the tubular members from becoming released from the grapple due to loss of tension. The lock-down releasable spear assembly of the present invention provides for locked engagement of a grapple with the interior diameter of a tubular member.

DESCRIPTION OF THE PREFERRED EMBODIMENT

The apparatus A of the present invention includes a releasing spear S (FIG. 1B) of known construction which engages the interior diameter of a tubular member T (FIG. 2) which can be casing, drill pipe or any other tubular member. The releasing spear S is oriented below a lock-down mechanism L on a common mandrel 10.

Figure 1A:
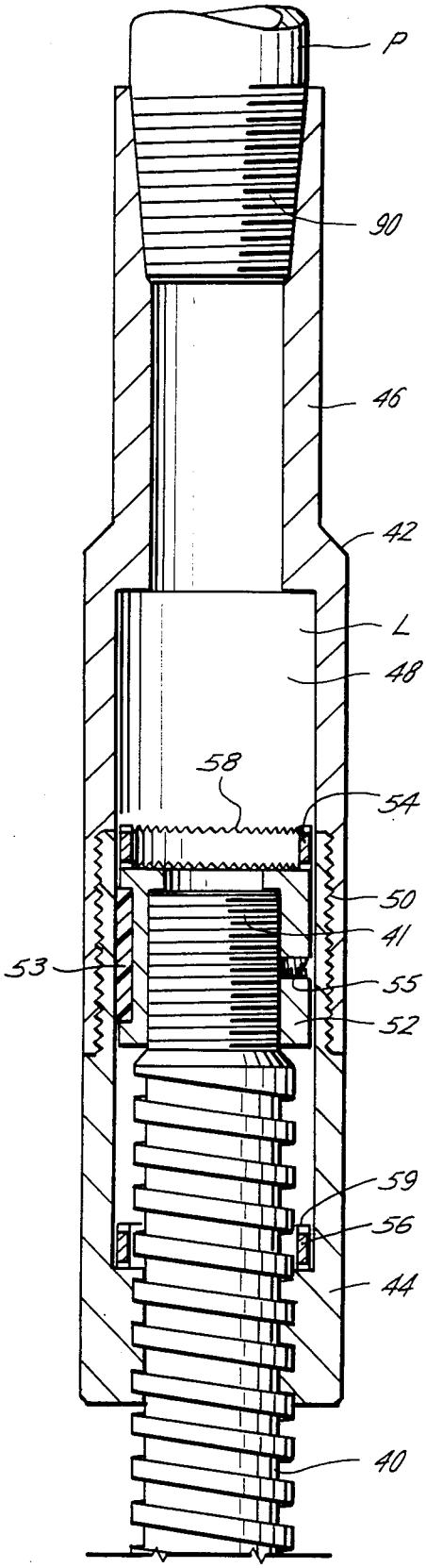
FIG. 1A is a side view, partially in cross-section, of the top portion of the present invention.
Figure 1B:
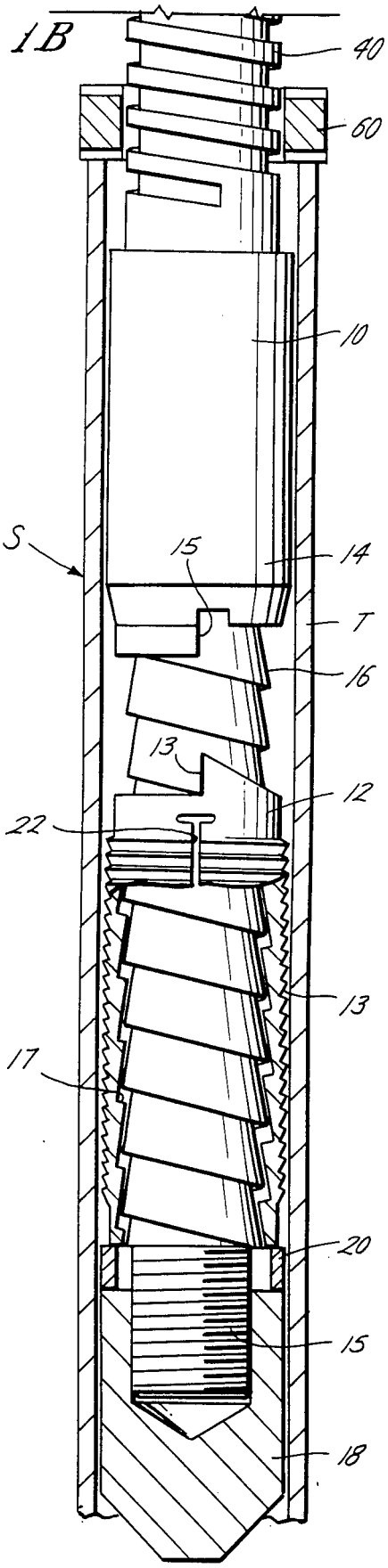
FIG. 1B is a side view, partially in cross-section, of the lower portion of the present invention.

The releasing spear S engages the interior diameter of the tubular member T through the expansion of grapple 12. The mandrel 10 includes a body 14 having extending downwardly therefrom a helix 16. Helix 16 terminates in a threaded pin 15 adapted to receive a nut 18. Nut 18 can be a bull nose nut as illustrated in FIG. 1B or a mill type, sub type, or side hill type nut. The nut 18 aligns the spear within the tubular member as the spear is lowered into the bore hole. Supported above nut 18 concentric with helix 16 is a release ring 20. Release ring 20 rests upon nut 18 with nut 18 and release ring 20 contacting at a zigzag surface 19.

Figure 5:
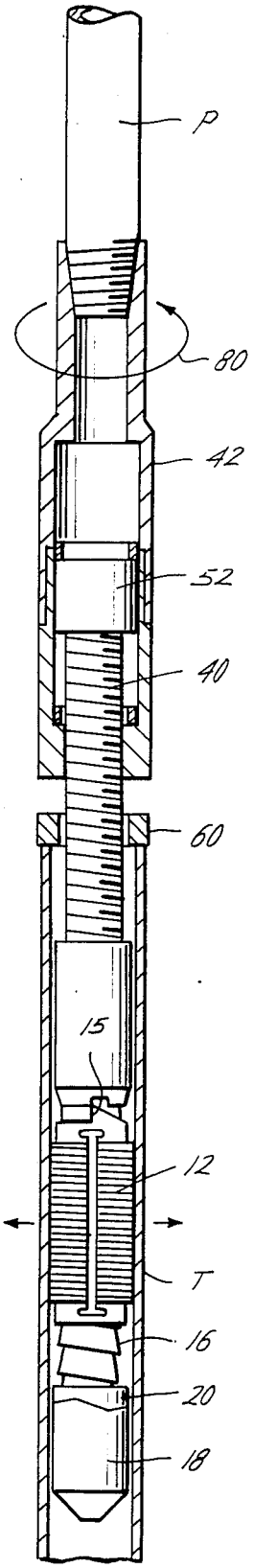

Also concentric with helix 16 oriented above release ring 20 is grapple 12. Grapple 12 includes outer serrations 13 which have a pitch adapted to engage the interior diameter of tubular member T when grapple 12 is slightly expanded and an upward pull is applied. The interior diameter of grapple 12 includes a helix 17 complementary to helix 16. Grapple 12 includes a longitudinal slot 22 extending for about the length of serrations 13 which allows for circumferential expansion of grapple 12 to engage the interior diameter of tubular member T. In practice, spear S is set within tubular member T by lowering the spear S into tubular member T with grapple 12 in a released position as shown in FIG. 1B. In the released position, grapple 12 is threaded downwardly on helix 16 so that grapple 12 rests upon release ring 20. With grapple 12 resting on release ring 20 for support, the expansion causing interaction of helixes 16 and 17 (described below) will not occur. When spear S is within tubular member T, mandrel 10 is then rotated counterclockwise so that grapple 12 is threaded up helix 16 to the point where finger 13 of grapple 12 contacts stop 15 of body 14 (FIG. 5). Grapple 12 is thus supported on mandrel 10 by the interaction of helix 16 and helix 17. Because of the close fit between the interior diameter of the tubular member T and serrations 13, when mandrel 10 is pulled upwardly, frictional gripping between grapple 12 and tubular member T occurs due to the slope of complementary helixes 16 and 17 which causes circumferential expansion of grapple 12 into engagement with the tubular member T. Such setting of spear S is well known to those skilled in the art.

Oriented above spear S is lock-down means L. Mandrel 10 includes an upwardly threaded extension 40 extending from body 14. Typically, the threads on threaded extension 40 are acme type or other flat, coarse threads. Extension 40 terminates in a threaded pin 41 adapted to receive a retaining cap 52. Concentric with threaded extension 40 is transfer assembly 42. Transfer assembly 42 includes a lower portion 44 threaded to receive threaded extension 40 and an upper box connection 46 adapted to receive the threaded pin 90 of the lower section of a pipe string P (FIG. 1A). Transfer assembly 42 includes a cavity 48 extending upwardly from threaded portion 44. Cavity 48 may be opened by removing lower portion 44 from the box connection 46 as by threaded joint 50. Within cavity 48 retaining cap 52 is threadedly attached to the threaded pin 41 of threaded extension 40. Retaining cap 52, which substantially radially fills cavity 48, includes a drag shoe 53 of nylon or other suitable material to provide for frictional movement between retaining cap 52 and transfer assembly 42. Retaining cap 52 is fixed against rotation to threaded pin 41 by lock screw 55 which releasably contacts threaded pin 41. Interposed above and below retaining cap 52 are break rings 54 and 56, respectively. Break rings 54 and 56 include serrated contact surfaces 58 and 59 to prevent retaining cap 52 from becoming jammed against lower threaded portion 44 or box connection 46. A third break ring 50 is preferably disposed between threaded extension 40 and body 10 to contact the casing as described below.

The lock section L allows for contact between lower threaded portion 44 and the tubular member T after grapple 12 has been set so that compression or lack of tension on the supporting tubing P will not release the engagement of grapple 12 with the interior diameter of tubular member T. The threaded engagement of lock section L to mandrel 10 when contacting the tubular member T provides the tension on mandrel 10 necessary to maintain engagement of grapple 12 regardless of the forces applied to the supporting tubing P.

Figure 2:
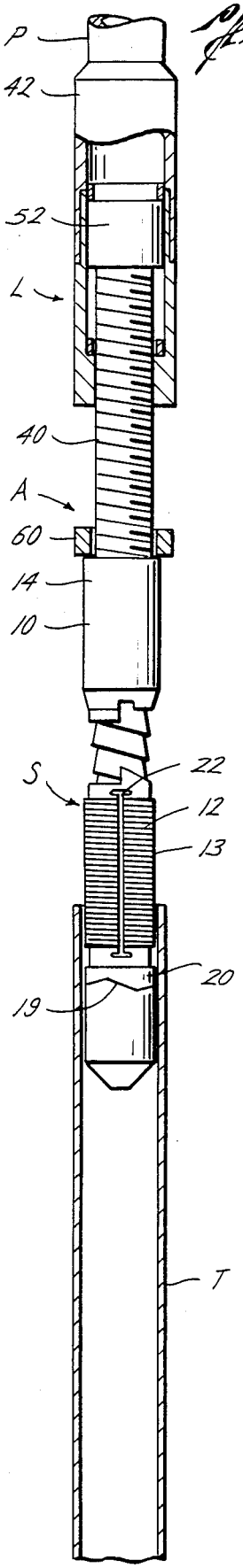
FIGS. 2–9 are side views, partially in cross-section, of the sequential steps of setting and releasing the lock-down releasable spear of the present invention.
Figure 3:
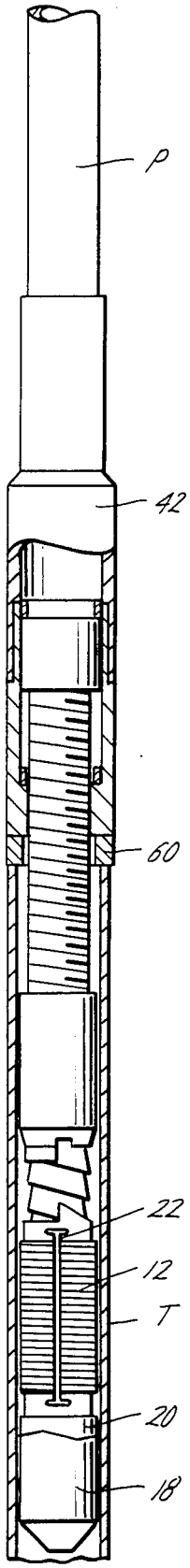
Figure 4:
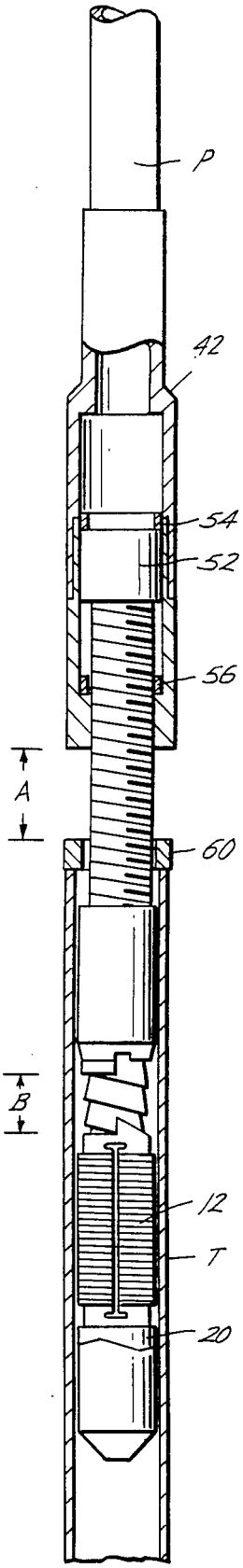

FIGS. 2–9 illustrate the method of the present invention. In FIG. 2, the spear S with grapple 12 resting on release ring 20 is lowered into the tubular member T. Break ring 60 rests upon body 14 concentric with threaded extension 40. FIG. 3 shows the spear as fully bottomed in the tubular member T with break ring 60 contacting tubular member T and transfer assembly 42. The apparatus is then lifted to a position (FIG. 4) where distance A is at least fifty percent greater than distance B to allow setting of grapple 12. In FIG. 5, grapple 12 is set by pulling upwardly so that grapple 12 frictionally engages the tubular member T. Mandrel 10 is then lowered and rotated counterclockwise (arrow 80) so that helix 16 moves downwardly through grapple 12 until finger 13 contacts stop 15 whereby grapple 12 is supported by the sloping surfaces of complementary helixes 16 and 17 (FIG. 1B). Because of the frictional engagement between grapple 12 and the interior diameter of tubular member T, when an upward tension is applied through mandrel 10, the wedge action of the sloping surfaces of helixes 16 and 17 expands grapple 12 into engagement with the interior surface of tubular member T. The setting of grapple 12 is accomplished without affecting the threaded engagement of lock assembly L due to the friction caused by drag shoe 53 on cap 52 (FIG. 1A).

Figure 6:
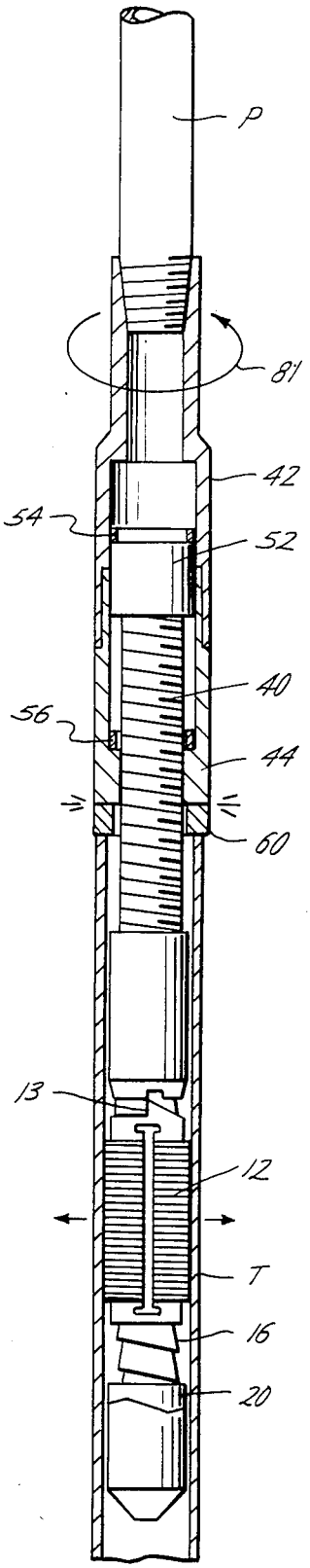

Upon setting of grapple 12 the apparatus is locked down by further counterclockwise rotation (Arrow 81, FIG. 6). Lower threaded portion 44 is moved downwardly on threaded extension 40 until contact with tubular member T is made by the lower end of the transfer assembly 42 with break ring 60, which is in position on the top of the tubular member T. Break ring 60 may be omitted, but it is preferably interposed between tubular member T and lower threaded extension 44 to prevent frictional locking of the contact surfaces on the bottom of members 42 and the top of tubular member T. Thereupon torque is applied to lock spear S, tubular member T, and lock-down assembly L in the relative position shown in FIG. 6. Typically, twenty to thirty percent of the pipe string breakout torque is applied to ensure that the apparatus is locked into position without releasing the threaded connections of the lengths or segments of support pipe 90 supporting the spear S. When locked as shown in FIG. 6, tension is maintained on grapple 12 by reason of the threaded engagement of the extension 40 and threaded portion 44, and the tension placed on the extension 40 due to the additional torque applied to the pipe string P after it is in the seated position (FIG. 6). Therefore, the engagement of the grapple 12 is not thereafter dependent on tension being maintained on the support pipe segments P. Thus, the pipe string P may then be in a neutrally loaded condition, or even under compressive loads without releasing the grapple 12 from the pipe T. Downward jarring can be effected on the stuck tubular member T without releasing the grapple 12.

Figure 7:
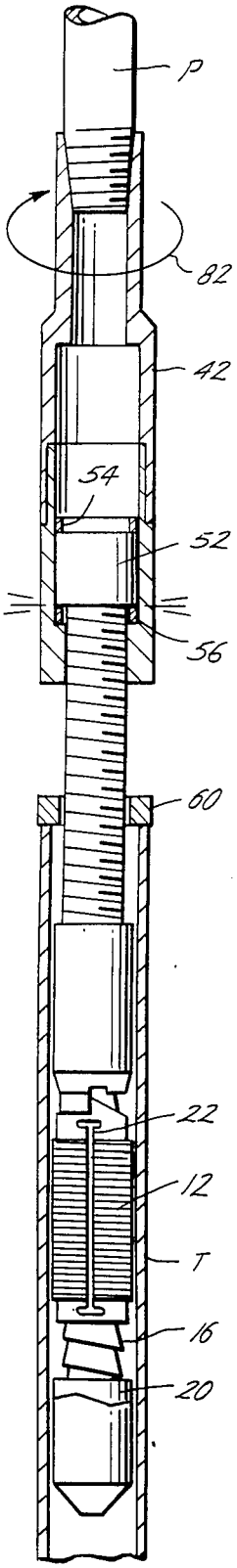
Figure 8:
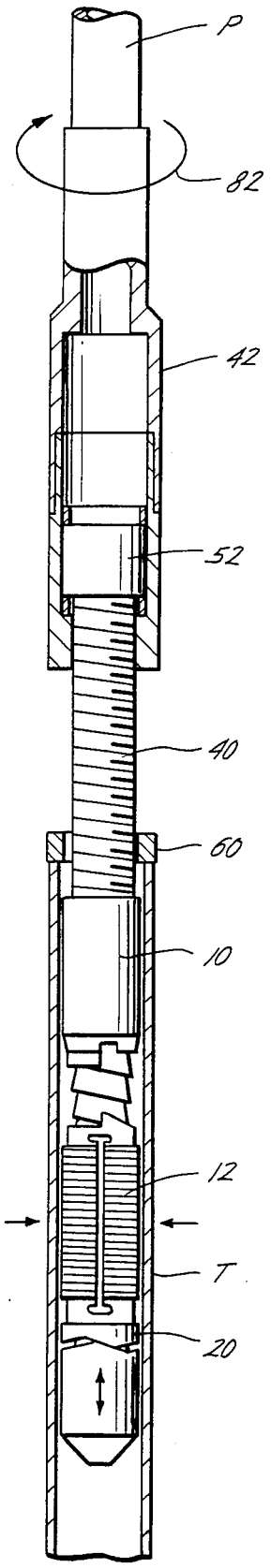
Figure 9:
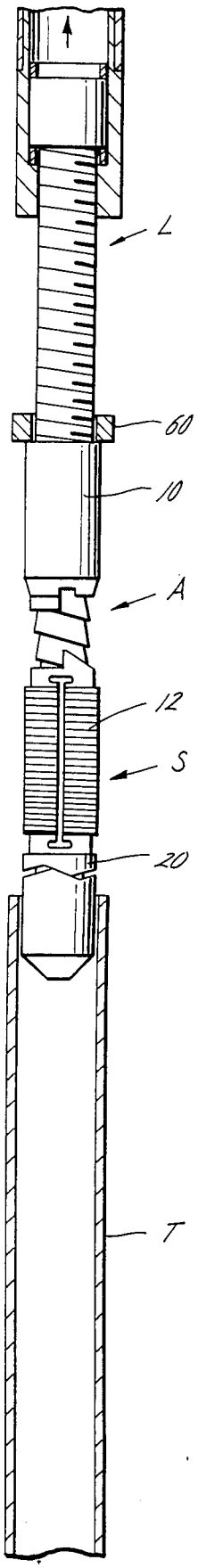

FIG. 7 shows the first step in the release of releasable spear S. Clockwise rotation (arrow 82) of pipe P and transfer assembly 42 releases the lock affect of lock-down assembly L, with break ring 60 having prevented jamming of the lower threaded extension 44 to tubular member T. Upon release of lock-down assembly L (FIG. 8), spear S is released by bumping down on mandrel 10 by a downward movement of pipe string 90 and further clockwise rotation (arrow 82) to release grapple 12. When grapple 12 has been released and rests upon release ring 20, upward tension can be applied to the spear S without grapple 12 expanding to engage the interior diameter of the tubular member T to thereby permit removal of the assembly A from tubular member T (FIG. 9).

It should be understood that the foregoing description and drawings of the invention are not intended to be limiting but are only exemplary of the inventive features which are defined in the claims. Although this invention has been illustrated and described for use in a well pipe, it should be understood that the invention is applicable and useful in any pipe wherein a tension-type spear is used to engage inside of the pipe, and compressive or non-tension loads are applied to the spear.

We claim:

1. A lockdown releasing spear assembly for releasably engaging the inner walls of a tubular member when a supporting mandrel for the spear is pulled upwardly to apply tension to the spear, the improvement comprising:

means to releasably lock the spear under tension in the tubular member by releasably locking the mandrel in position relative to the tubular member after the spear has gripped the inner wall of the tubular member to prevent a release of the spear from its gripping contact with the inner wall of the tubular member when a load ranging from tension to compression is applied to the supporting mandrel;

said means for releasably locking the mandrel to the tubular member including a transfer assembly operatively connected to the mandrel and adapted to abut the end of the tubular member after the spear is in gripping engagement with the tubular member;

said transfer assembly including means to prevent separation of said mandrel from operative connection to said transfer assembly; and said means to prevent separation including a retaining cap on said mandrel positioned within a cavity in said transfer assembly above the operative connection between said transfer assembly and said mandrel.

2. The lock-down releasing spear of claim 1, further including frictional contact means between said retaining cap and said transfer assembly.

3. A lock-down releasing spear assembly for releasably engaging the inner surface of a tubular member, comprising:

a releasable pipe spear having an expandable grapple threadedly engaging a first lower section of a mandrel and adapted to fit within and releasably engage the inner surface of a tubular member; and a transfer assembly threadedly engaging a second upper section of said mandrel to releasably contact an end surface of the tubular member after the grapple is in engagement with the tubular member, said second upper section of said mandrel including a retaining cap thereon fitted within a cavity in said transfer assembly above the threaded engagement between said transfer assembly and said second upper section to prevent complete release of said second section from said transfer assembly.

4. The lock-down releasing spear of claim 3, further including frictional contact means between said retaining cap and the cavity within said transfer assembly.

5. A lockdown releasing spear assembly for releasably engaging in the inner wall of a tubular member when a supporting mandrel for the spear is pulled upwardly to apply tension to the spear, the improvement comprising:

means to releasably lock the spear under tension in the tubular member by releasably locking the supporting mandrel to the tubular member after the spear has gripped the inner wall of the tubular member comprising a transfer assembly operatively connected to the mandrel and adapted to abut an end surface of the tubular member after the spear is in gripping engagement with the tubular member wherein said transfer assembly includes means to prevent separation of said mandrel from operative connection to said transfer assembly comprising a retaining cap on said mandrel positioned within a cavity in said transfer assembly above the operative connection between said transfer assembly and said mandrel.

6. The lockdown releasing spear of claim 5, further including frictional contact between said retaining cap and said transfer assembly.

7. A lockdown releasing spear assembly for releasably engaging the inner surface of a tubular member, comprising:

a releasable pipe spear having an expandable grapple threadedly engaging a first lower section of a mandrel and adapted to fit within and releasably engage the inner surface of a tubular member; and a transfer assembly threadedly engaging a second upper section of said mandrel to releasably contact an end surface of the tubular member after the grapple is in engagement with the tubular member, said second upper section of said mandrel including a retaining cap thereon fitted within a cavity in the transfer assembly above the threaded engagement between said transfer assembly and said second upper section to prevent complete release of said second upper section from said transfer assembly.

8. The lockdown releasing spear of claim 7, further including frictional contact means between said retaining cap and the cavity within said transfer assembly.

* * * * *